US008167746B2

(12) United States Patent
Massaro

(10) Patent No.: US 8,167,746 B2
(45) Date of Patent: May 1, 2012

(54) PORTABLE PITCHING RUBBER

(76) Inventor: William Massaro, Havertown, PA (US)

( * ) Notice: Subject to any disclaimer, the term of this patent is extended or adjusted under 35 U.S.C. 154(b) by 0 days.

(21) Appl. No.: 12/795,936

(22) Filed: Jun. 8, 2010

(65) Prior Publication Data

US 2010/0248868 A1 Sep. 30, 2010

Related U.S. Application Data

(63) Continuation-in-part of application No. 12/111,318, filed on Apr. 29, 2008, now abandoned.

(51) Int. Cl.
*A63B 71/00* (2006.01)

(52) U.S. Cl. ..... 473/497; 473/451

(58) Field of Classification Search ..... 473/497, 473/499, 422, 452, 451; D21/780; 428/43, 428/85, 99

See application file for complete search history.

(56) References Cited

U.S. PATENT DOCUMENTS

| | | | | |
|---|---|---|---|---|
| 2,064,134 | A | | 12/1936 | Weiland |
| 2,156,469 | A | | 5/1939 | Boltz |
| 2,189,428 | A | | 2/1940 | Love |
| 2,662,768 | A | | 12/1953 | Madsen |
| 2,992,005 | A | | 7/1961 | Lockhart |
| 3,158,893 | A | | 12/1964 | Smith |
| 3,479,028 | A | | 11/1969 | Goeders |
| 3,489,411 | A | | 1/1970 | Morelli |
| 3,703,285 | A | | 11/1972 | Perry |
| 3,837,646 | A | | 9/1974 | Goeders |
| 4,097,628 | A | | 6/1978 | Cheris et al. |
| 4,223,835 | A | | 9/1980 | Witt et al. |
| 4,306,718 | A | | 12/1981 | Goeders |
| 4,340,633 | A | | 7/1982 | Robbins, Jr. |
| 4,561,653 | A | | 12/1985 | Wright |
| 4,591,154 | A | | 5/1986 | Santarone |
| 4,666,155 | A | | 5/1987 | Stille |
| 4,692,364 | A | | 9/1987 | Altus |
| 4,749,223 | A | | 6/1988 | Goeders |
| 4,856,779 | A | * | 8/1989 | Wallendal ..... 473/497 |
| 4,925,186 | A | | 5/1990 | Stevenson et al. |
| 5,188,357 | A | | 2/1993 | Barnum |
| 5,204,159 | A | | 4/1993 | Tan |
| 5,213,323 | A | | 5/1993 | Novinsky |
| 5,308,083 | A | * | 5/1994 | Grunfeld et al. ..... 273/400 |
| 5,318,290 | A | | 6/1994 | Sawyer |
| 5,467,977 | A | | 11/1995 | Beck |
| 5,624,112 | A | | 4/1997 | Hummel et al. |
| 5,769,745 | A | | 6/1998 | Bartoli |
| 5,827,140 | A | | 10/1998 | Bartoli |
| 5,916,045 | A | | 6/1999 | Busch |
| 5,919,103 | A | | 7/1999 | Bartoli |
| 6,177,165 | B1 | | 1/2001 | Robbins, III et al. |

(Continued)

FOREIGN PATENT DOCUMENTS

WO WO 03/080197 A1 10/2003

*Primary Examiner* — Mitra Aryanpour

(74) *Attorney, Agent, or Firm* — Caesar, Rivise, Bernstein, Cohen & Pokotilow, Ltd.

(57) ABSTRACT

A portable pitching rubber adapted to be firmly but removably mounted to an underlying surface without damaging the underlying surface. The pitching rubber includes a pad having a top surface, a bottom surface, two longitudinal side surfaces, two transverse side surfaces and a plurality of spikes extending from the bottom surface of the pad. The spikes are directed at acute angles towards adjacent longitudinal side surfaces.

7 Claims, 2 Drawing Sheets

U.S. PATENT DOCUMENTS

| | | | | |
|---|---|---|---|---|
| 6,183,833 | B1 | 2/2001 | Robbins, III et al. | |
| 6,284,341 | B1 | 9/2001 | Robbins, III et al. | |
| 6,287,659 | B1 | 9/2001 | Robbins, III et al. | |
| 6,346,050 | B1 | 2/2002 | Larson | |
| 6,386,996 | B1 | 5/2002 | Foster | |
| 6,843,739 | B2 | 1/2005 | Putnam | |
| 6,946,184 | B2 | 9/2005 | Robbins, III | |
| 7,018,301 | B1 | 3/2006 | Cascerceri et al. | |
| 7,029,743 | B2 | 4/2006 | Robbins, III | |
| 2003/0181269 | A1 | 9/2003 | Griffin | |
| 2006/0237575 | A1* | 10/2006 | Van Hierden | 242/406 |
| 2007/0181171 | A1* | 8/2007 | Roberts | 135/118 |
| 2011/0003652 | A1* | 1/2011 | Brend | 473/452 |

* cited by examiner

PORTABLE PITCHING RUBBER

This application is a continuation-in-part of U.S. patent application Ser. No. 12/111,318 (Massaro).

BACKGROUND OF THE INVENTION

The present invention relates generally to athletic equipment and more specifically to a portable pitching rubber for training and sporting activities, such as softball, baseball and other sports, which may be firmly but removably mounted to a variety of surfaces, including artificial or synthetic surfaces such as artificial turf, carpeting and matting, but may be easily moved from place to place without damaging the surfaces or any underlying substrates.

Certain indoor and outdoor training and sporting exercises require the use of a designated area for a person to deliver (e.g., pitch, throw, kick) a ball or other similar object to another person. For example, pitching mounds are a traditional part of the games of baseball, and a pitching rubber is typically mounted at generally the center portion of the pitching mound. Similarly, softball utilizes a pitching circle in which a pitching rubber is typically mounted at generally the center portion of the circle. Traditionally, pitching rubbers have been designed to be stationarily mounted to a surface so that a pitcher can push off the rubber when throwing the ball to a batter. If appropriately designed and used, these devices can also promote the development of proper pitching fundamentals.

A pitching rubber is typically made of a hard rubber material of elongated rectangular shape, and in accordance with the rules of the games, the pitcher must be in contact with the pitching rubber while throwing, e.g., a baseball or softball. While U.S. Pat. No. 4,561,653 of Wright describes some differences between baseball and softball as they relate to pitching technique and pitching mounds, pitching rubbers in both sports are typically similar in size, shape and material. In both baseball and softball, pitching rubbers are subjected to a high degree of force, notwithstanding that the forces in the two sports are somewhat different due to differences in pitching motion (i.e., wind-up). As a result, a pitching rubber must be secured to, for example, a pitching mound or some other surface in order to prevent the rubber from moving during each pitch sequence.

Traditionally, pitching rubbers used for playing baseball outdoors have been secured to pitching mounds by driving relatively large, metal posts or spikes attached to the underside of the rubber a sufficient distance into the ground which forms the pitching mound. As a result, such pitching rubbers are typically not easily removed from the ground and doing so often requires the use of tools to force the posts out of ground. Such rubbers also cannot be used effectively indoors without providing a sufficient amount of ground material (e.g., soil, sand, dirt) so that the posts can be hammered into the material to secure the rubber.

Several pitching rubbers have been patented including, for example, the pitching rubber described in U.S. Pat. No. 5,188,357 of Barnum. The Barnum pitching rubber has flanges secured at each end of the rubber for receiving a post. As is the case with other known pitching rubbers having posts or large spikes, the post of the Barnum pitching rubber must be driven or pounded into the ground to secure the pitching rubber in place and be pried out of the ground to remove and relocate the rubber.

Similarly, Bartoli also describes pitching rubbers in U.S. Pat. Nos. 5,769,745, 5,827,140 and 5,919,103. The Bartoli pitching rubbers include a metal plate secured to the rubber surface, a post extending from the plate for inserting into a ground anchor, and a pair of spikes also extending from the plate to prevent movement of the outer edges of the pitching rubber. Also, a principal feature of the Bartoli pitching rubbers is the provision of having a stationary mounting portion and a removable portion such that the pitching rubber assembly can be mounted at various pitching distances to accommodate different game requirements.

While athletes, including baseball and softball pitchers, often train indoors, the use of traditional outdoor pitching rubbers is often impossible and, at best, difficult and inconvenient. Many known pitching rubbers cannot be mounted or otherwise attached to most indoor surfaces, including artificial or synthetic surfaces. While it may be possible to remove the metal posts from traditional pitching rubbers in order to use them inside, doing so requires using some attaching means (e.g., tape, glue, etc.) so that the rubber does not move during pitch deliveries. While doing so could be considered marginally effective, this type of training can lead to problems, including injuries to athletes and the development of poor pitching technique, as pitching rubbers which are not adequately secured to a surface have a tendency to shift or move.

U.S. Patent Application Publication No. 2003/0181269 A1 of Griffin describes a portable pitching rubber for indoor use. The Griffin pitching rubber comprises a plurality of suction devices for securing the rubber to hard, smooth surfaces, such as hardwood, concrete and tile flooring. However, the pitching rubber of Griffin is ineffective when the suction devices are unable to secure the rubber to an underlying surface, including surfaces which are not hard and/or smooth, such that the rubber is prevented from moving or slipping during a pitch sequence.

BRIEF SUMMARY OF THE INVENTION

Accordingly, there is provided a portable pitching rubber adapted to be firmly but removably mounted to an underlying surface without damaging the underlying surface. The pitching rubber includes a pad having a top surface, a bottom surface, two longitudinal side surfaces, two transverse side surfaces and a plurality of spikes extending from the bottom surface of the pad. The spikes are directed at acute angles towards adjacent longitudinal side surfaces.

In another embodiment, there is provided a combination portable pitching rubber and artificial surface. The pitching rubber is adapted to firmly but removably mount to the artificial surface without damaging it. The pitching rubber includes a pad having a top surface, a bottom surface, two longitudinal side surfaces, two transverse side surfaces and a plurality of spikes extending from the bottom surface of the pad. The spikes are directed at acute angles towards adjacent longitudinal side surfaces. The artificial surface includes a substrate portion and fibers anchored thereto. The combination includes the pitching rubber firmly but removably mounted to the artificial surface such that the bottom surface of the pad is in contact with the artificial surface and the spikes engage and are removably imbedded within the fibers of the artificial surface without damaging the artificial surface.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

As described in U.S. Patent Application Publication No. 2003/0181269 A1 of Griffin, which is incorporated herein by reference in its entirety, the pad portion of a pitching rubber is typically composed of a solid rubber, plastic or polymer material and is white in color. Pitching rubbers currently on the market are available in different sizes. For example, pitching rubbers used by Major League Baseball® are 24 inches long and 6 inches wide while other pitching rubbers are smaller in size (e.g., 18 inches long and 4 inches wide). Thicknesses of known pitching rubbers also vary; however, as described in Griffin, a thickness range of about ¾ inch to 1 inch (0.65 cm to 2.54 cm) is common.

Figure 1:
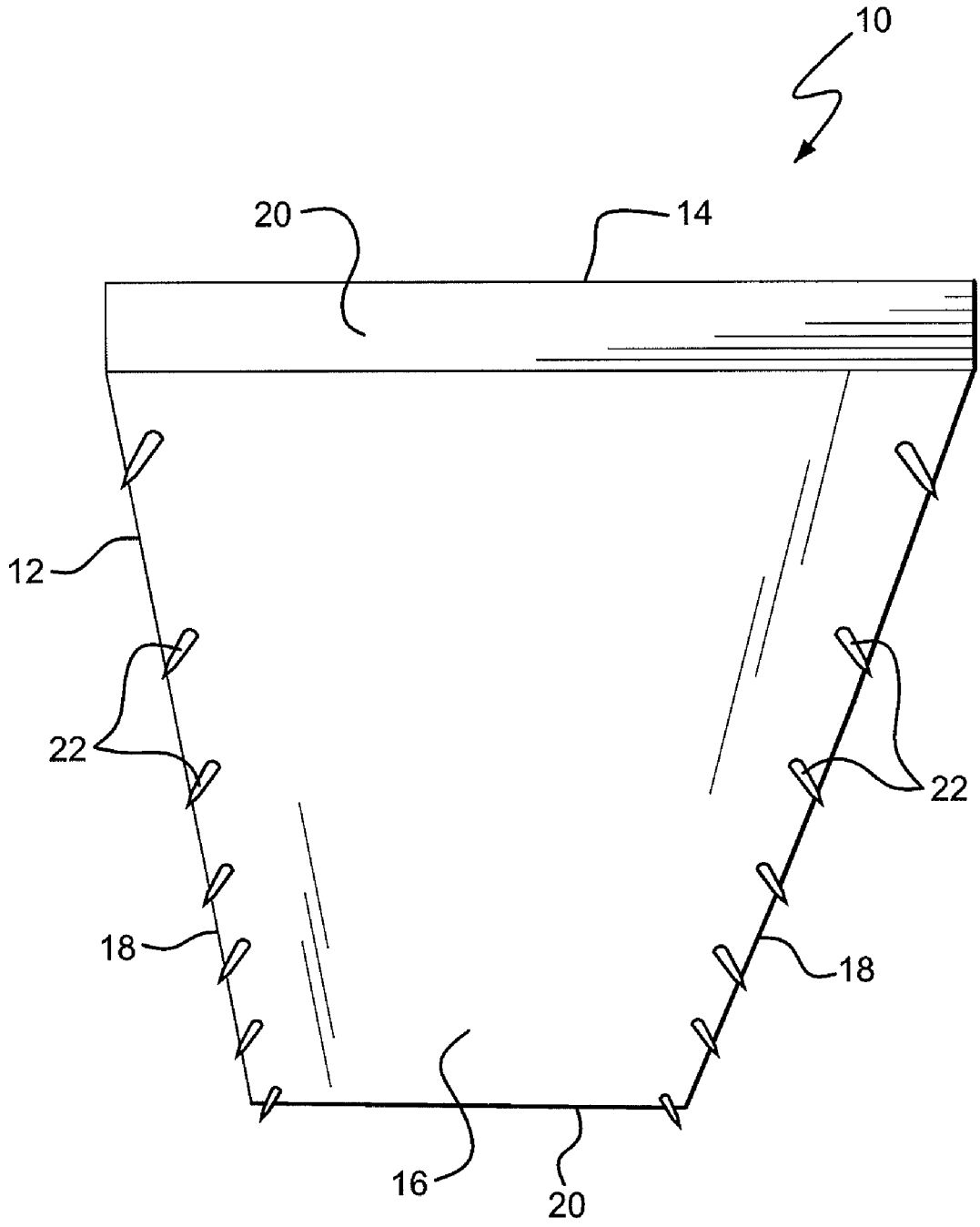
FIG. 1 is an isometric view of a pitching rubber according to the present invention.

Referring to FIG. 1, there is shown an embodiment of a pitching rubber 10 according to the present invention. The pitching rubber 10 comprises a pad 12 having a top surface 14, a bottom surface 16, two longitudinal side surfaces 18, two transverse side surfaces 20, and a plurality of spikes 22 extending from the bottom surface 16 of the pad 12. The plurality of spikes 22 are directed at acute angles towards respective adjacent longitudinal side surfaces 18.

Each spike 22 is preferably spaced equidistant from each other spike 22 and is adjacent to a respective longitudinal side surface 18 of the pad 12. It has been found that about seven spikes 22 in this configuration per side (i.e., a total of fourteen spikes) are sufficient to firmly mount the pad 12 to an artificial or synthetic surface. However, it will be understood by those of ordinary skill in the art that an additional number of spikes 22 and/or alternative configurations may be used to firmly mount the pad 12 to various surfaces. For example, five to ten spikes per side (L e., a total of ten to twenty spikes) may be appropriate. Alternatively, spikes may extend from the bottom surface 16, adjacent to respective transverse side surfaces 20 of the pad 12 (not shown). It may also be possible to use fewer spikes 22 depending on several variables, including the type and length of the spikes 22 as well as the nature of the surface on which the pitching rubber 10 is used.

Figure 1D:
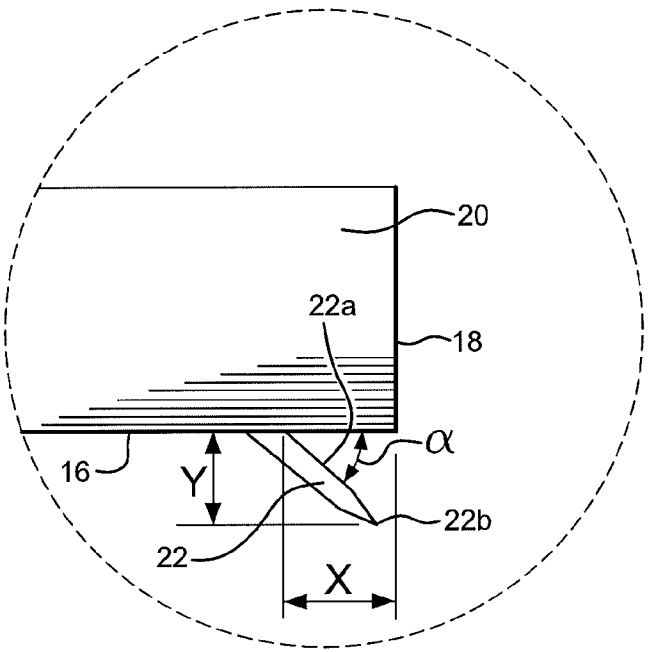
FIG. 1*d* is an enlarged view of a portion of the pitching rubber as shown in FIG. 1*a*.
Figure 1A:
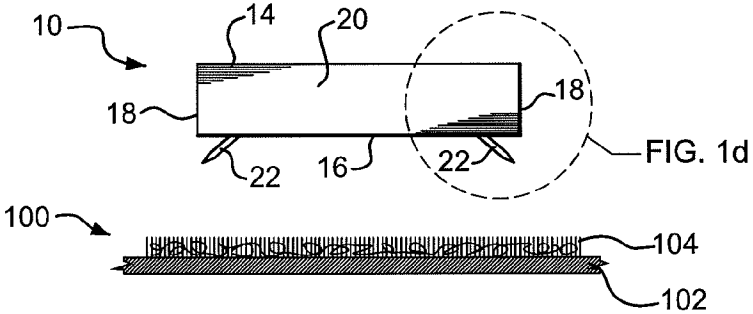
FIG. 1*a* is a side view of the pitching rubber of FIG. 1 prior to its being firmly and removably mounted to artificial turf.

Referring now to FIG. 1*a*, there is shown a side view of the pitching rubber 10 of FIG. 1 prior to its being firmly and removably mounted to artificial turf 100. The artificial turf 100 includes at least one substrate layer 102 comprising foam, rubber or any other material commonly used for artificial turf substrates. Artificial turf fibers 104 are permanently embedded in or otherwise anchored to the substrate layer 102 according to commonly known methods and materials for achieving the same.

Referring now to FIG. l*b*, there is shown a side view of the pitching rubber 10 of FIG. 1 that is firmly and removably mounted to the artificial turf 100. As shown in FIG. l*b*, the spikes 22 extend at acute angles from the bottom surface 16 of the pad 12 into the artificial turf 100 such that that the spikes 22 engage and are removably imbedded within the artificial turf fibers 104 without damaging them. In this position, the spikes 22 may also slightly engage and/or compress the substrate layer 102 without damaging it.

Figure 1B:
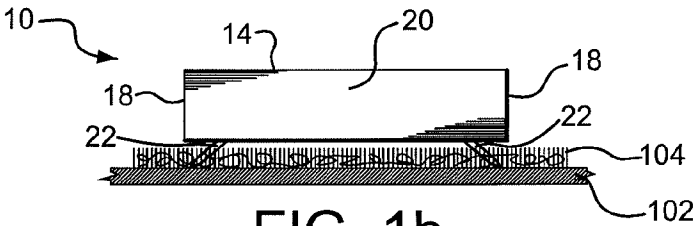
FIG. 1*b* is a side view of the pitching rubber of FIG. 1 that is firmly and removably mounted to artificial turf.

As explained in greater detail below, to firmly and removably mount the pitching rubber 10 to the artificial turf 100, e.g., as illustrated in FIG. 1*b*, it is preferred, although not necessarily required, that a user apply weight or pressure on the pitching rubber 10 once it is placed in a desired location. When the pitching rubber 10 is mounted to the artificial turf 100, e.g., as shown in FIG. 1*b*, the angular positioning of the spikes 22 in combination with the artificial turf fibers 104 provides resistance to translational forces acting on the pad 12 when in use, thereby rendering the pitching rubber 10 firmly mounted to the artificial turf 100.

Figure 1C:
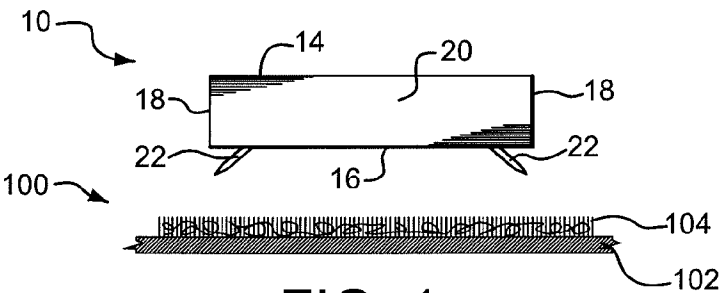
FIG. 1*c* is a side view of the pitching rubber of FIG. 1 after it has been removed from artificial turf.

As explained in greater detail below, when a user is finished using the pitching rubber 10, the user would simply lift and remove the pad 12 from the artificial turf 100, thereby disengaging the spikes 22 therefrom. FIG. 1*c* is a side view of the pitching rubber of FIG. 1 after it has been removed from the artificial turf 100. As can be seen in FIG. 1*c*, neither the artificial turf fibers 104 nor the substrate layer 102 are damaged by the spikes 22. A person of ordinary skill would appreciate that alternative artificial surfaces to artificial turf 100, including, but not limited to carpeting or matting may also be used in combination with the pitching rubber 10.

Referring now to FIG. 1*d*, there is shown an enlarged view of a portion of the pitching rubber shown in FIG. 1*a*. Each spike 22 has an outer surface 22*a* that faces generally towards an adjacent longitudinal side surface 18 of the pad 12. Each spike 22 further includes a preferably sharp tip 22*b*. FIG. 1*d* provides reference dimensions for the spikes 22 wherein: "X" represents the distance from the intersection of the outer surface 22*a* of each spike 22 and the bottom surface 16 of the pad 12 to the adjacent longitudinal side surface 18 of the pad 12; "Y" represents the distance from the tip 22*b* of each spike 22 to the bottom surface 16 of the pad 12; and "$\alpha$" represents the angle between the outer surface 22*a* of each spike 22 and the bottom surface 16 of the pad 12. Preferably, X is about ½ inch to about 1 inch, Y is about ½ inch to about 1 inch and $\alpha$ is about 30-60 degrees, and is most preferably about 45 degrees.

It has been found that the foregoing dimensions for the spikes 22 are sufficient to firmly mount the pad 12 to several different artificial surfaces without damaging such surfaces. However, the foregoing preferred dimensions for the spikes 22 are not absolute and may be varied, even substantially. Those of ordinary skill in the art will appreciate that alternative dimensions for the spikes 22 can be used effectively to firmly mount the pitching rubber 10 to an underlying surface, without damaging that underlying surface. Moreover, regardless of the specific dimensions chosen for the spikes 22, it is preferred that the tip 22*b* of each spike 22 approaches, but does not reach the same plane as the adjacent longitudinal side surface 18, e.g., as shown in FIGS. l*a-d*.

The spikes 22 may be made of several different types of materials, including various metals, high strength plastics, ceramics and the like; however, preferably, the spikes 22 are made of a strong metal alloy material such as steel. The shape and size of the spikes 22 may also vary and can include, for example, various shape and size nails, screws and tacks. As already alluded to, the optimum number of spikes 22 extending from the bottom surface 16 of the pad 12 will depend on several factors including the location, angle, length, shape and size of the spikes 22 extending from the bottom surface 16 of the pad 12.

Several methods may be used for making a portable pitching rubber according to the present invention. The pad 12 may be manufactured by traditional methods for making pitching rubber pads, including being molded or cut to a desired shape and size. The spikes 22 may be made by the same or similar methods of making nails, screws and the like, including machining the spikes 22 to a variety of specifications as described above.

Referring again to FIG. 1, the spikes 22 may simply be screws that are screwed into the top surface 14 of the pad 12 until portions of the screws extend from the bottom surface 16 of the pad 12. Alternatively, the spikes 22 may be nails that are hammered into the top surface 14 of the pad 12 until portions of the nails extend from the bottom surface 16 of the pad 12. In this way, for example, an existing pitching rubber may be altered to make a pitching rubber according to the present invention. In another embodiment, the spikes 22 may be similar to spikes used on the bottom of golf shoes wherein the spikes 22 may be easily added or removed, if desired, from ports (not shown) in the bottom surface 16 of the pad 12. In yet another embodiment, a plate (not shown) made from a suitable material, e.g., metal, may be secured either to the bottom surface 16 of the pad 12 or within the pad 12. The spikes 22 may be secured to or integral with the plate and extend from the bottom surface 16 of the pad 12.

Pitching rubbers according to the present invention are portable and convenient to use. A pitching rubber according to the present invention may be used both indoors and outdoors on a variety of different artificial surfaces. For example, in order to use the pitching rubber 10 of the embodiment shown in FIG. 1, a user simply needs to place the pitching rubber 10 on a surface such as artificial turf at a desired location. In order to ensure that the spikes 22 are in sufficient contact with an underlying surface such that the pitching rubber 10 is firmly mounted to the surface, it is preferred, although not necessarily required, that the user place a sufficient amount of weight or pressure on the pitching rubber 10 after placing it in a desired location so that the spikes 22 are adequately contained in the surface. For example, if desired, the pitching rubber 10 may be placed on artificial turf and a user can walk on the pitching rubber 10 to ensure that the spikes 22 are forced further into the artificial turf thereby ensuring that the pitching rubber is firmly mounted so as to resist translational forces applied to the pitching rubber 10. It will be appreciated that stepping on the pitching rubber 10 is usually done as a matter of course during use of the pitching rubber 10. When finished using the pitching rubber 10 the user simply needs to lift and remove the pad 12 from the underlying surface thereby disengaging the spikes 22 therefrom.

Various types of artificial turf may be used effectively including AstroTurf®. Similarly, various types of carpeting and matting materials may also be used effectively with a pitching rubber of the present invention. However, the surfaces on which the pitching rubber of the present invention may be used effectively is not limited to artificial turf, carpeting or matting. Rather, the pitching rubber is adapted for use on any surface that will allow the spikes to be at least partially imbedded in at least a portion of the surface in order to firmly mount the pitching rubber to the surface. Furthermore, the pitching rubber may be easily removed from the surface without damaging the surface.

While the invention has been described in detail and with reference to specific examples thereof, it will be apparent to one skilled in the art that various changes and modifications can be made therein without departing from the spirit and scope thereof.

What is claimed:

1. A combination portable pitching rubber and artificial turf, the pitching rubber comprising a pad having a top surface, a bottom surface, two longitudinal side surfaces, two transverse side surfaces and a plurality of spikes extending from the bottom surface of the pad, wherein the spikes are directed at acute angles towards adjacent longitudinal side surfaces, the artificial turf comprising a substrate portion and fibers anchored thereto, the combination comprising the pitching rubber resting atop the artificial turf such that the bottom surface of the pad is in contact with the artificial turf and the spikes engage and are removably imbedded within the fibers, the spikes contacting the substrate portion without damaging the substrate portion of the artificial turf.

2. The combination of claim 1, wherein each of the spikes has a tip, the distance from the tip of each spike to the bottom surface of the pad being about ½ inch to about 1 inch.

3. The combination of claim 2, wherein each of the spikes has an outer surface facing generally towards a longitudinal side surface of the pad to which a respective spike is adjacent, the distance from the intersection of the outer surface of the respective spike and the bottom surface of the pad to the longitudinal side surface of the pad to which the respective spike is adjacent being about ½ inch to about 1 inch.

4. The combination of claim 1, wherein the spikes are adjacent to respective longitudinal side surfaces of the pad.

5. The combination of claim 1, wherein each of the spikes has an outer surface facing generally towards a longitudinal side surface of the pad to which a respective spike is adjacent, wherein the angle between the outer surface of the respective spike and the bottom surface of the pad is about 30 degrees to about 60 degrees.

6. The combination of claim 5, wherein the angle between the outer surface of the respective spike and the bottom surface of the pad is about 45 degrees.

7. The combination of claim 1 wherein the spikes are spaced approximately equidistant from each other adjacent to respective longitudinal side surfaces of the pad, wherein each of the spikes has a tip and an outer surface facing generally towards a longitudinal side surface of the pad to which a respective spike is adjacent, the distance from the intersection of the outer surface of the respective spike and the bottom surface of the pad to the longitudinal side surface of the pad to which the respective spike is adjacent being about ½ inch to about 1 inch, the distance from the tip of the respective spike to the bottom surface of the pad being about ½ inch to about 1 inch and the angle between the outer surface of the respective spike and the bottom surface of the pad being about 30 degrees to about 60 degrees.

* * * * *